US011015256B2

(12) United States Patent
Lee et al.

(10) Patent No.: US 11,015,256 B2
(45) Date of Patent: May 25, 2021

(54) NEAR FIELD TRANSDUCERS INCLUDING ELECTRODEPOSITED PLASMONIC MATERIALS AND METHODS OF FORMING

(71) Applicant: SEAGATE TECHNOLOGY LLC, Cupertino, CA (US)

(72) Inventors: Lien Lee, St. Paul, MN (US); Jie Gong, Eden Prairie, MN (US); Venkatram Venkatasamy, Edina, MN (US); Yongjun Zhao, Eden Prairie, MN (US); Lijuan Zou, Eden Prairie, MN (US); Dongsung Hong, Edina, MN (US); Ibro Tabakovic, Edina, MN (US); Mark Ostrowski, Lakeville, MN (US)

(73) Assignee: Seagate Technology LLC, Fremont, CA (US)

( * ) Notice: Subject to any disclaimer, the term of this patent is extended or adjusted under 35 U.S.C. 154(b) by 157 days.

(21) Appl. No.: 16/160,671

(22) Filed: Oct. 15, 2018

(65) Prior Publication Data

US 2019/0048487 A1 Feb. 14, 2019

Related U.S. Application Data

(63) Continuation of application No. 14/036,032, filed on Sep. 25, 2013, now Pat. No. 10,100,422.

(51) Int. Cl.

| | |
|---|---|
| ***C25D 5/02*** | (2006.01) |
| ***C25D 7/00*** | (2006.01) |
| ***C25D 5/10*** | (2006.01) |
| *C25D 1/00* | (2006.01) |

(52) U.S. Cl.

CPC ..... *C25D 5/022* (2013.01); *C25D 5/10* (2013.01); *C25D 7/00* (2013.01); *C25D 1/003* (2013.01)

(58) Field of Classification Search

None

See application file for complete search history.

(56) References Cited

U.S. PATENT DOCUMENTS

| | | | | |
|---|---|---|---|---|
| 6,110,823 | A | 8/2000 | Eldridge | |
| 6,255,040 | B1 | 7/2001 | Sasaki | |
| 6,281,106 | B1 | 8/2001 | Higdon | |
| 6,982,519 | B2 | 1/2006 | Guillorn | |
| 8,416,647 | B1 * | 4/2013 | Zhao | G11B 5/3133 369/13.01 |
| 10,100,422 | B2 * | 10/2018 | Lee | C25D 7/00 |
| 2007/0029911 | A1 | 2/2007 | Hudspeth | |
| 2008/0265411 | A1 | 10/2008 | Hu | |
| 2009/0220633 | A1 | 9/2009 | Despa | |
| 2011/0210444 | A1 | 9/2011 | Jeng | |

FOREIGN PATENT DOCUMENTS

| | | | | |
|---|---|---|---|---|
| KR | 20040076165 | * | 8/2004 | H01L 23/28 |

* cited by examiner

*Primary Examiner* — Stefanie S Wittenberg
(74) *Attorney, Agent, or Firm* — Mueting Raasch Group

(57) ABSTRACT

Methods of forming near field transducers (NFTs) including electrodepositing a plasmonic material.

9 Claims, 10 Drawing Sheets

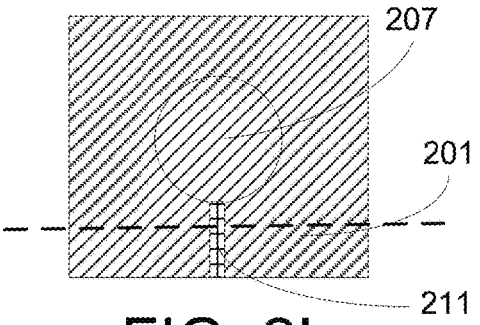
FIG. 2I
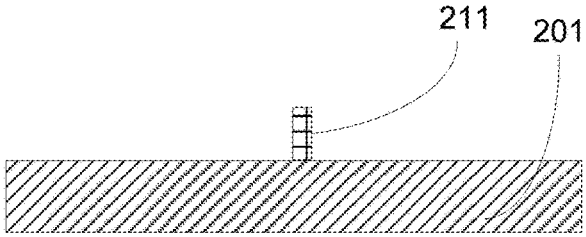
FIG. 2J
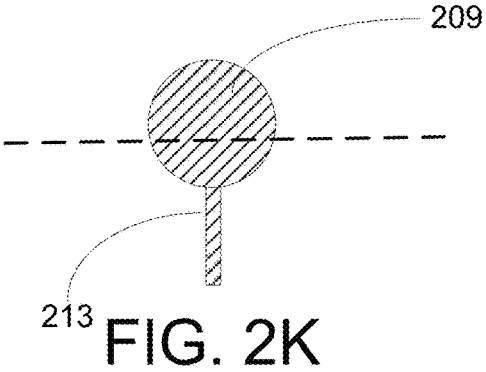
FIG. 2K
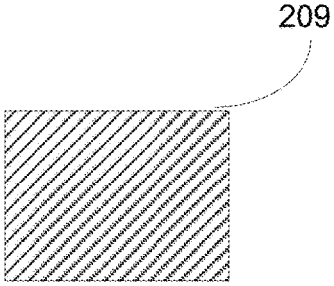
FIG. 2L
FIG. 2M
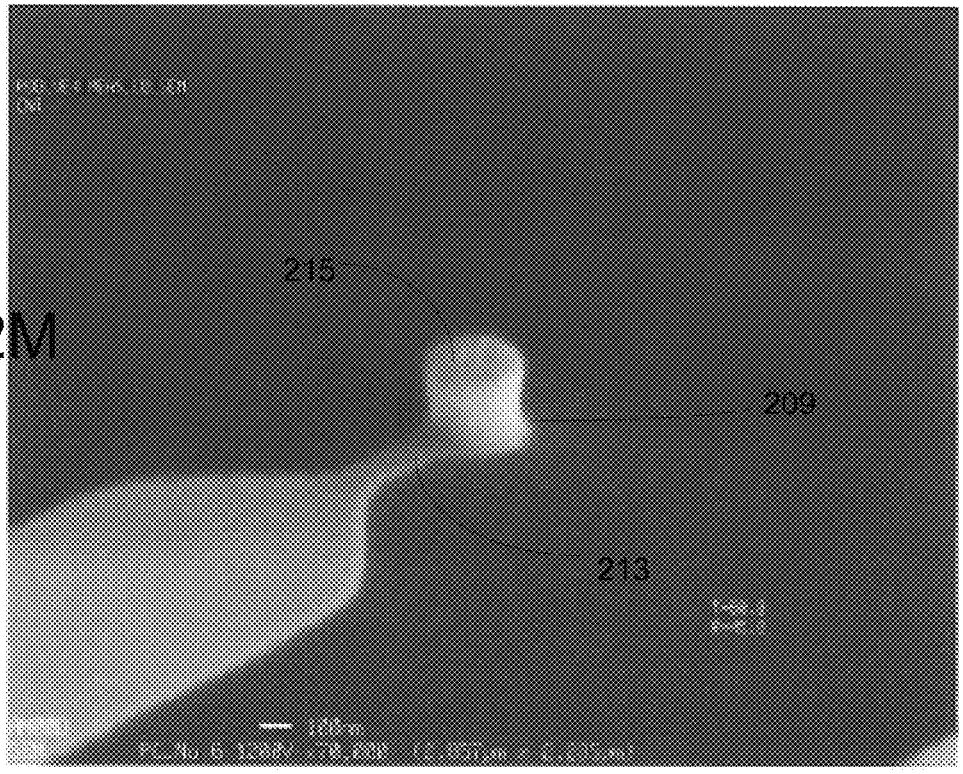

NEAR FIELD TRANSDUCERS INCLUDING ELECTRODEPOSITED PLASMONIC MATERIALS AND METHODS OF FORMING

SUMMARY

A method of forming a lollipop type near field transducer (NFT), the method including the steps of forming a rod, wherein the rod is electrically grounded; forming a photoresist mask, the photoresist mask forming at least one opening, wherein the rod is situated at least partially within the at least one opening; electrodepositing material within the at least one opening; and removing the photoresist mask.

A method of forming a lollipop type near field transducer (NFT), the method including the steps of electrodepositing a sheet of a first plasmonic material; forming a photoresist mask, the photoresist mask forming at least one opening; electrodepositing a second plasmonic material at least in the at least one opening of the photoresist mask; removing the photoresist mask; and forming a rod, wherein the rod is formed from at least a portion of the first plasmonic material.

A method of forming a lollipop type near field transducer (NFT), the method including the steps of electrodepositing a sheet of a first plasmonic material; forming a photoresist mask, the photoresist mask forming at least one opening; electrodepositing a second plasmonic material at least in the at least one opening of the photoresist mask, wherein the second plasmonic material does not entirely fill the at least one opening; depositing a diffusion barrier material on the second plasmonic material in at least the at least one opening; removing the photoresist mask; and forming a rod, wherein the rod is formed from at least a portion of the first plasmonic material.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

BRIEF DESCRIPTION OF THE FIGURES

FIGS. 1A through 1H depict top-down (FIGS. 1A, 1C, 1E, and 1G) and cross-section (FIGS. 1B, 1D, 1F, and 1H) views of devices at various stages of fabrication according to disclosed exemplary methods. While

FIGS. 2A through 2M depict top-down (FIGS. 2A, 2C, 2E, 2G, 2I, and 2K), cross-section (FIGS. 2B, 2D, 2F, 2H, 2J, and 2L), and a SEM (FIG. 2M) views of devices at various stages of fabrication according to disclosed exemplary methods.

FIGS. 4A through 4E are atomic force microscopy (AFM) images of sputtered and electrodeposited (ED) gold before and after annealing, with FIG. 4A being an AFM image of as deposited sputtered gold; FIG. 4B being an AFM image of the same sputtered gold after being annealed at about 300° C. for about 15 minutes; FIG. 4C being an AFM image of as deposited electrodeposited gold; FIG. 4D being an AFM image of the same electrodeposited gold after being annealed at about 300° C. for about 15 minutes; and FIG. 4E being an AFM image of electrodeposited gold after being annealed at about 250° C. for about 24 hours.

FIG. 5B being a TEM image of the same sputtered gold after being annealed at about 300° C. for about 15 minutes; FIG. 5C being a TEM image of a 250 nm thick as deposited electrodeposited gold; and FIG. 5D being a TEM image of the same electrodeposited gold after being annealed at about 300° C. for about 15 minutes.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1A:
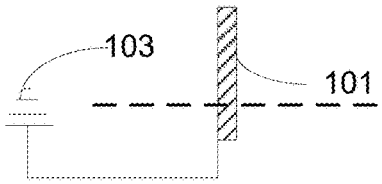

In the following description, reference is made to the accompanying set of drawings that form a part hereof and in which are shown by way of illustration several specific embodiments. It is to be understood that other embodiments are contemplated and may be made without departing from the scope or spirit of the present disclosure. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the properties sought to be obtained by those skilled in the art utilizing the teachings disclosed herein.

The recitation of numerical ranges by endpoints includes all numbers subsumed within that range (e.g. 1 to 5 includes 1, 1.5, 2, 2.75, 3, 3.80, 4, and 5) and any range within that range.

As used in this specification and the appended claims, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

"Include," "including," or like terms means encompassing but not limited to, that is, including and not exclusive. It should be noted that "top" and "bottom" (or other terms like "upper" and "lower") are utilized strictly for relative descriptions and do not imply any overall orientation of the article in which the described element is located.

Disclosed herein are methods of producing near field transducers (NFTs) and the NFTs produced thereby. Disclosed methods include electrodeposition steps and/or methods. Electrodeposited materials, such as electrodeposited plasmonic materials can provide advantageous optical properties. Electrodeposited materials, such as electrodeposited plasmonic materials can also provide advantageous morphological properties after annealing and therefore provide more reliable structures. Disclosed methods may also provide advantageous properties because the disc of the NFT and/or as associated heat sink made using any of the disclosed methods have a cylindrical profile. Such cylindrical profiles may provide advantageous heat sinking properties. NFTs made by electrodepositing the plasmonic material may also have characteristic microstructure profiles. It should also be noted that the NFT need not have a cylindrical profile, but can have any shape, for example, NFTs can be oval in shape.

Some exemplary methods can include fabricating the disc portion of a lollipop type NFT (also referred to as a "NTL") and a heatsink associated with the disc with electrodeposition by using the rod (which can also be referred to as the peg) of the NTL as a grounding path. Such approaches may be advantageous because multiple layers (either of different materials or materials having similar or disparate properties) can be plated using a single lithography mask. From a processing standpoint, this can be advantageous both with respect to efficiency and cost. Such methods could be referred to as bottom up approach. An example of such a disclosed method is exemplified by the depictions in FIGS. 1A-1H. FIGS. 1A, 1C, 1E, and 1G show top down views of a portion of a structure being produced, while FIGS. 1B, 1D, 1F, and 1H show a cross section (taken at the plane depicted by the dashed line in the preceding figure) of a portion of the structure being produced.

Figure 1B:
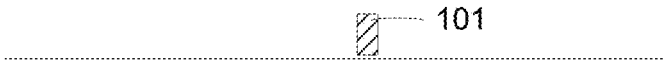

FIGS. 1A and 1B show the rod 101, which is electrically grounded, e.g., electrically coupled to ground 103. The rod 101 can be made using any method, for example it can be made using chemical deposition, electrodeposition, physical deposition, or otherwise. In some embodiments, the rod 101 can be formed by depositing the rod material (via electrodeposition or some other deposition method), patterning, and milling, for example. In some embodiments, the rod 101 can have dimensions from 20 nm to 60 nm, for example. Generally, the rod 101 can be located on a wafer and can be electrically grounded. The rod 101 can generally be made of a plasmonic material. The rod 101 can be made of the same or a different plasmonic material than that which the disc will ultimately be formed from. In some embodiments, the rod and the disc can be formed from the same material. Exemplary plasmonic materials can include, for example gold (Au), silver (Ag), copper (Cu), and alloys thereof (with any elements, including those listed herein). In some embodiments, elements can be added to plasmonic materials (such as Au, Ag, or Cu for example) in order to impart desired properties to the plasmonic materials. The addition of such additional elements can generally be added in amounts that do not detrimentally affect the plasmonic properties of the plasmonic material. Dimensions and configurations of useful rods could be similar to those commonly utilized for NTLs. It should also be noted that the rod need not be a simple "line" shape, but can have different configurations. For example, in some embodiments, the configuration of the rod can be chosen such that there is a larger rod/disc contact area.

Figure 1C:
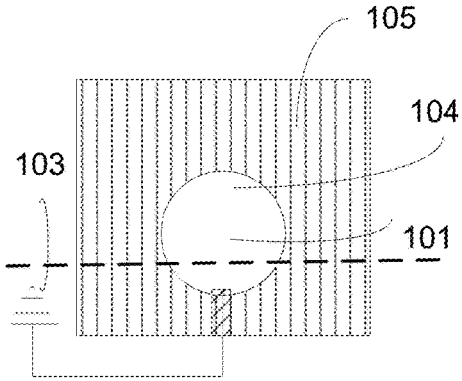
Figure 1D:
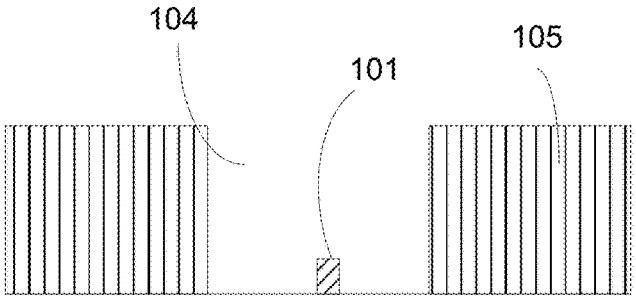

FIGS. 1C and 1D show a photoresist mask 105 that can be formed using known lithographic techniques and processes. The photoresist mask 105 is configured so that at least one opening 104 exists that can be utilized to form the disc of the NTL. The opening 104 can generally be described as a region where the photoresist mask has been removed. In some embodiments, such as that depicted herein, the disc, can have a circular configuration, for example. The opening 104 of the photoresist mask 105 can be situated such that at least a portion of the rod 101 extends into the opening 104. This allows the rod 101 to function as the electrical ground for the material that will be electrodeposited in the opening 104 in a subsequent step. The dimensions and configurations of the photoresist mask and associated opening(s) could be similar to the dimensions and configurations of NTLs.

Figure 1E:
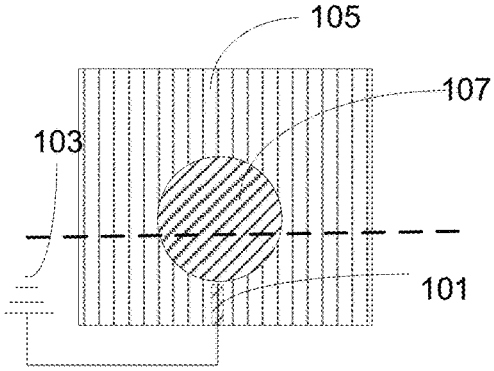
Figure 1F:
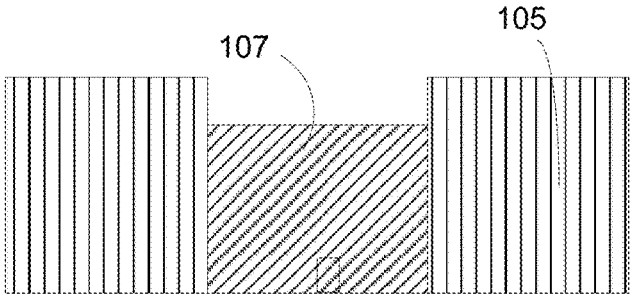

FIGS. 1E and 1F show the device after the next step, electrodeposition of the disc 107. The disc 107 is deposited using electrodeposition methods. When utilizing electrodeposition methods, the rod 101 functions as the ground for the electrodeposition method. Therefore, the material being electrodeposited will be deposited from the rod 101 outward. Generally, the electrodeposited material is deposited in the opening 104. Exemplary electrodeposition conditions and particulars thereof can include, for example, a cyanide-containing bath or a non-cyanide bath. For example, a cyanide bath could typically contain 10-20 g/l of $KAu(CN)_2$, 30-70 g/l of Citrate acid, with pH adjusted between 3-4. The plating current density could be 10-20 $mA/cm^2$. A non-cyanide type sulfite-thiosulfate bath could also be used for the Au film electrodeposition. This type of a bath could contain NaAuCl 0.05-0.1M, $Na_2SO_3$ 0.3-6M, $Na_2S_2O_3$ 0.4-0.6M and $Na_2HPO_4$ 0.2-0.6M, at pH 6-8 and plated at a current density of 1-3 $mA/cm^2$.

In some embodiments, more than one material can be electrodeposited within the opening of the photoresist mask 105. In some embodiments, the first material that is deposited will be deposited from the rod outward, and can therefore be chosen to provide particular properties at that region, for example, high thermal conductivity, and/or ability to function as a diffusion barrier. In some embodiments, for example, the first material that can be deposited within the opening of the photoresist mask 105 can function as diffusion barrier. In such embodiments, this material could be deposited over the entire bottom surface of the opening. Exemplary materials that could function as diffusion barriers can include, for example rhodium (Rh), tungsten (W), tantalum (Ta), tantalum nitride (TaN), ruthenium (Ru), titanium (Ti), and titanium nitride (TiN). Once such a diffusion barrier has been deposited, a plasmonic material can then be deposited thereon. As such, disclosed methods can include one or more than one electrodeposition step.

Such methods can be advantageous because more than one layer or structure (for example a diffusion barrier and the plasmonic material of the disc) can be deposited using only one lithography step (e.g., formation of one photoresist mask). Stated another way, such bottom up methods can provide engineering flexibility to integrate the formation of different materials having different thermal, diffusion, or plasmonic materials while only utilizing one lithography step. Such methods can also have advantages over methods of forming NTLs that utilize vacuum deposition methods because it can be easier to control the thickness of the material when electrodeposition is utilized (in comparison to vacuum deposition).

Figure 1G:
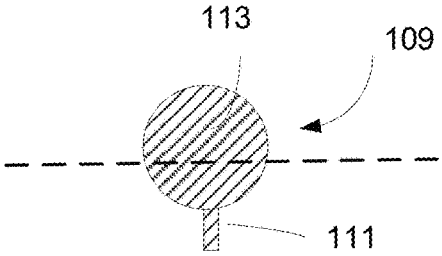
Figure 1H:
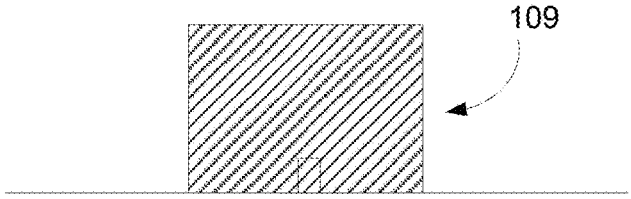

FIGS. 1G and 1H show the device after the next step, removal of the photoresist mask, thereby forming the NTL 109. The NTL 109 includes the peg 111 and the disc 113. The photoresist mask can be removed using processes and techniques known to those familiar with photolithography methods, for example various etching steps.

Figure 1I:
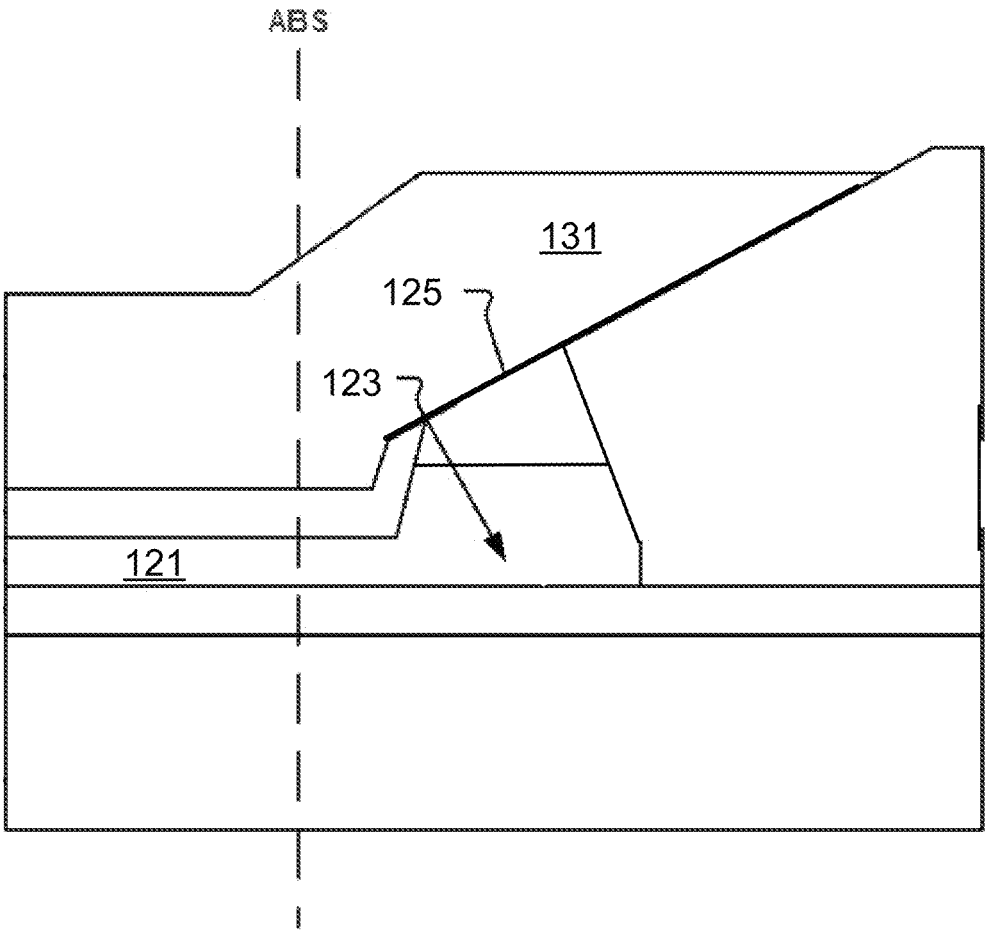
FIG. 1I is a cross section of a particular embodiment of a device that could be formed using disclosed methods.

As discussed above, methods such as those disclosed herein can be advantageous because they can offer processing efficiencies if more than one material is being utilized. Such advantages are present in the specific example where a disc and subsequent diffusion barrier to the subsequent write pole layer are formed. FIG. 1I shows a cross section of a completely formed device that includes a rod 121, a disc 123, and a diffusion barrier 125. This device also includes a write pole 131. The disc 123 and diffusion barrier 125 were formed by electrodepositing, using the rod 121 as ground. In the context of the method described above (with respect to FIGS. 1A through 1H), the disc 123 could be electrodeposited first (again, using the road 121 as a ground), and then the diffusion barrier 125 could be electrodeposited on top of the disc 123. This step could be carried out in-situ by simply changing the electrodeposition bath. The device, after deposition of the diffusion barrier material could then be milled (for example at an angle as seen in FIG. 1I) before the write pole is formed thereon. As such, the diffusion barrier 125 then ends up between the disc, which can include plasmonic material and the write pole, which can include magnetic material. It should also be noted that in the embodiment depicted in FIG. 1I, not all of the structure indicated as the disc 123 need function as a near field transducer, some portion (e.g., a portion past about 25 nm from the underlying surface) can function as a heat sink. The advantage can also be characterized as a processing advantage because both the disc material and the diffusion barrier material (diffusion barrier between the disc and the write pole) can be electrodeposited using the rod as a ground.

Another example of disclosed methods is depicted in FIGS. 2A through 2L. FIGS. 2A, 2C, 2E, 2G, 2I, and 2K show top down views of a portion of the structure being produced, while FIGS. 2B, 2D, 2F, 2H, 2J, and 2L show a cross section (taken at the plane depicted by the dashed line in the previous figure) of a portion of the structure being produced.

Figure 2A:
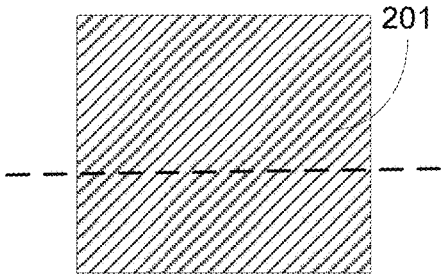
Figure 2B:
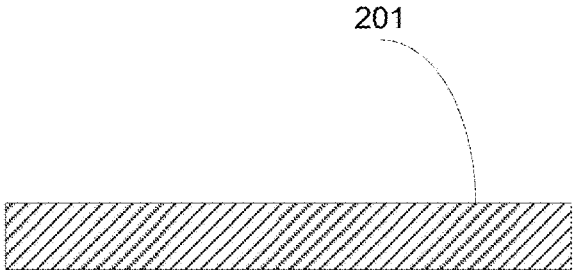
Figure 2C:
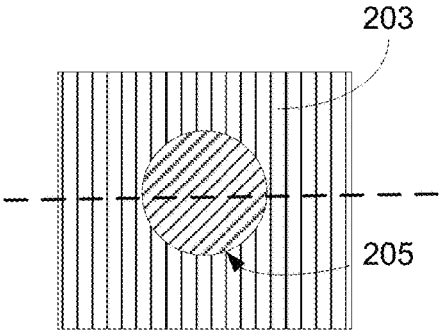
Figure 2D:
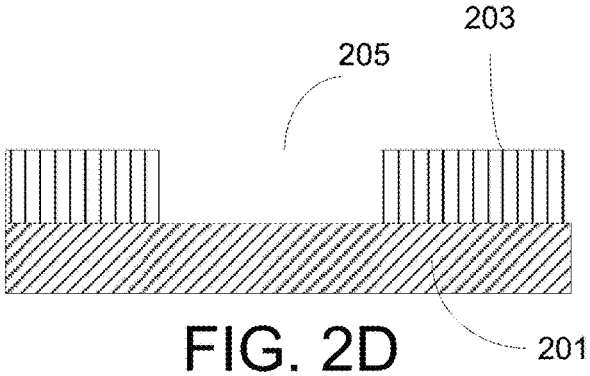

A first step in methods such as those depicted in FIGS. 2A through 2L includes electrodepositing a sheet 201 of a first material. The first material can have various properties but in most instances, can be electrically conductive so it can function as a ground for subsequent electrodeposition steps. In some embodiments, the first material can be a conductive material, for example a plasmonic material (which is also electrically conductive), as seen in FIGS. 2A and 2B. In some embodiments, the first material could include zirconium (Zr), zirconium nitride (ZrN), tantalum (Ta), titanium tungsten (TiW), or chromium (Cr) for example. In some embodiments, the first material could include a plasmonic material such as Au, Ag, Cu, or alloys thereof. The sheet of conductive material can generally have any useful thickness. In some embodiments, the sheet of conductive material can be of a thickness that is at least substantially the same as a targeted thickness for the rod of a NTL. For example, the sheet of conductive material can have a thickness from 1 to 10 nm, of from 1 to 5 nm for example. Generally, the sheet of conductive material need only cover the area where a NTL (or NTLs) is to be formed, but can cover a larger surface area.

A next step in disclosed methods can include a step of forming a photoresist mask 203. A device after such a step can be seen in FIGS. 2C and 2D, for example. The photoresist mask 203 can be configured so that at least one opening 205 remains that can be utilized to form a disc of an NTL. In some embodiments, a photoresist mask 205 can include more than one opening. In some embodiments, such as that depicted herein, the disc can have a circular configuration. The dimensions and configurations of the photoresist mask 203 could be similar to dimensions and configurations of discs of NTLs. In some embodiments, the depth of the opening 205 may be from 15 nm to 350 nm, for example. The depth of the opening 205 may dictate, at least in part, the thickness of the disc of a NTL. A layer of the conductive material (for example a plasmonic material) will exist below the opening 205.

Figure 2E:
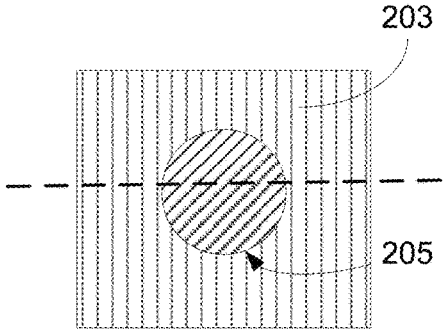
Figure 2F:
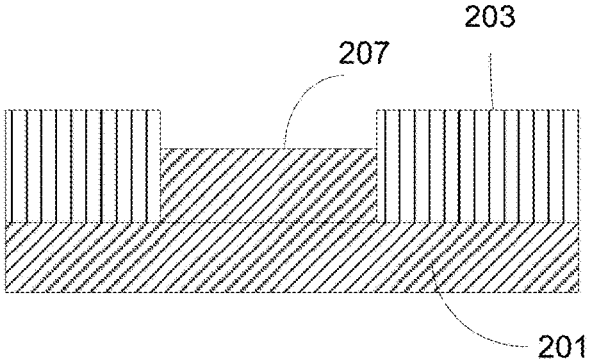
Figure 2G:
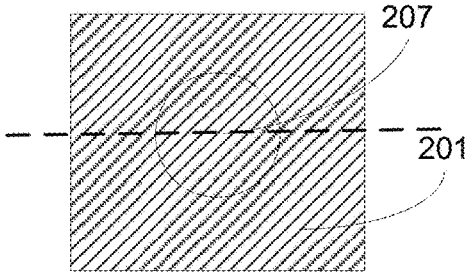
Figure 2H:
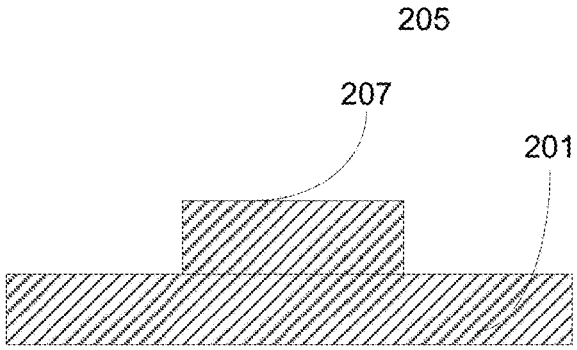

A next step in disclosed methods can include a step of electrodepositing a second material, or a second plasmonic material. A device after such a step can be seen in FIGS. 2E and 2F. The device includes the sheet of conductive material 201, the photoresist mask 203 and a plasmonic material 207. As seen in FIGS. 2E and 2F, the plasmonic material 207 can be deposited at least in the at least one opening 205 of the photoresist mask (although it could also be deposited at other locations). Exemplary plasmonic materials can include, for example gold (Au), silver (Ag), Cu, or alloys thereof (as discussed above, elements alloyed in may provide advantageous properties without detrimentally affecting the plasmonic properties). In some embodiments, the plasmonic material deposited in the at least one opening can form a disc of a NTL. In some embodiments, part of the plasmonic material deposited in the at least one opening can function as the disc of a NTL and part of the plasmonic material deposited in the at least one opening can function as a heat sink of a NTL.

A next optional step, which is not specifically depicted in FIGS. 2A through 2L can include deposition of a third material on the second plasmonic material 207. This material can be designed to function as a heat sink for the disc of the NTL, a diffusion barrier for the disc of the NTL, some other function for the NTL, or combinations thereof.

A next step includes removal of the photoresist mask. A device after such a step can be seen in FIGS. 2G and 2H. The device includes the sheet of conductive material 201, and the disc 207 (this material can also be characterized as a disc/heatsink). The photoresist mask can be removed using processes and techniques known to those utilizing photolithography methods.

A next step includes patterning of the rod feature of the NTL. This step can include photolithography steps, for example, the area where the rod is to be located can be protected by a rod mask 211, as seen in FIGS. 2I and 2J. The rod mask 211 functions to maintain the first plasmonic material 201 below it when the other plasmonic material is removed.

A next step can include removal of all un-protected material. A device after this next step is depicted in FIGS. 2K and 2L, for example. The device includes the rod 213 and the disc 209. This step can be accomplished using known photolithography techniques and processes. A next optional step, or an optional step in conjunction with removal of all un-protected material includes removing other unwanted material. The unwanted material removed at this step can include, for example, photoresist material remaining from patterning the rod feature of the NTL, extraneous plasmonic material (see plasmonic material 201 above), other material utilized during the process or present on the wafer that was begun with, or any combination thereof. Processes utilized to carry out this step can vary based on the materials being removed. Exemplary processes that can be utilized can include, for example, milling, etching (e.g., inductively coupled plasma (ICP) etching, reactive ion etching (RIE), chemical etching, etc.) stripping (photoresist stripping, etc.), others, or combinations thereof.

A scanning electron microscope (SEM) image of a finished NTL prepared using a method such as that described with respect to FIGS. 2A through 2L, can be seen in FIG. 2M. This particular NTL includes a rod 213, a disc 209 and an optional heat sink 215 located thereon.

Methods such as those depicted in FIGS. 2A through 2L can also include an optional preliminary step (not depicted in FIGS. 2A through 2L) wherein a preliminary layer is deposited on the surface of the substrate (for example the wafer) before the plasmonic material 201 is electrically deposited. The preliminary layer can be chosen to function as a seed layer, an adhesion layer, some other function, or some combination thereof. In some embodiments, the preliminary layer can function as a seed layer. In some embodiments where the plasmonic material layer (e.g., layer 201) is to be gold, this preliminary layer (if it is to act as a seed layer) can include vacuum deposited gold. In some embodiments, this preliminary layer can generally have a thickness up to 1 nm, for example.

Methods such as those depicted by FIGS. 2A through 2L may be advantageous because more than one layer or structure (for example a diffusion barrier and the plasmonic material of the disc, the plasmonic material of the disc and a heat sink thereon, a diffusion barrier, the plasmonic material of the disc, and a heat sink thereon) can be deposited using only one lithography step (e.g., formation of one photoresist mask forming the opening for the disc). Such methods can also be advantageous because both the rod and the disc of the NTL are formed using electrodeposition, allowing the entire structure to take advantage of properties of electrodeposited materials. These methods can also be advantageous because the base of the rod and the disc were originally deposited as one layer, therefore there is no transition from the disc to the rod, which could reduce the transfer of energy from the disc to the rod.

Another example of disclosed methods is depicted in FIGS. 3A through 3L. FIGS. 3A, 3C, 3E, 3G, 3I and 3K show top down views of a portion of the structure being produced, while FIGS. 3B, 3D, 3F, 3H, 3J and 3L show a cross section (taken at the plane depicted by the dashed line in the previous figure) of a portion of the structure being produced.

Figure 3A:
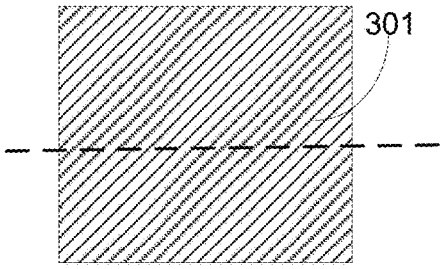
FIGS. 3A through 3L depict top-down (FIGS. 3A, 3C, 3E, 3G, 3I, and 3K) and cross-section (FIGS. 3B, 3D, 3F, 3H, 3J, and 3L) views of devices at various stages of fabrication according to disclosed exemplary methods.
Figure 3B:
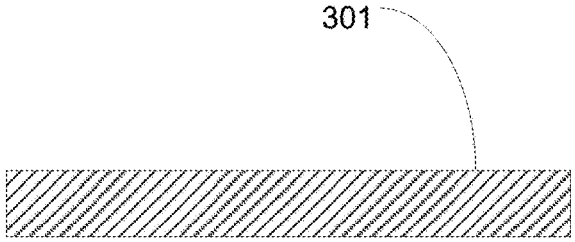
Figure 3C:
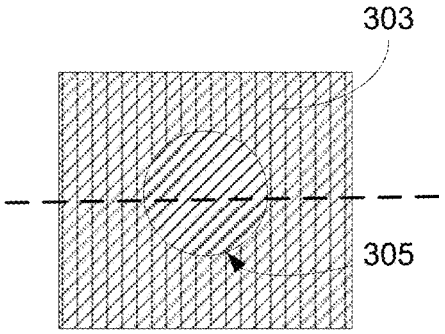
Figure 3D:
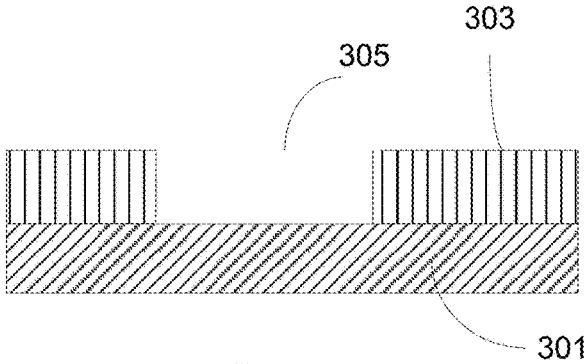

A first step in methods such as those depicted in FIGS. 3A through 3L includes electrodepositing a sheet 301 of a first material, for example a plasmonic material, as seen in FIGS. 3A and 3B. The sheet of plasmonic material can generally have any useful thickness. In some embodiments, the sheet of plasmonic material can be of a thickness that is at least substantially the same as a targeted thickness for the rod of a NTL. Generally, the sheet of plasmonic material need only cover the area where a NTL is to be formed, but can cover a larger surface area. It should also be noted that an optional preliminary layer as discussed with respect to FIGS. 2A through 2L above can also be utilized in methods such as those depicted by FIGS. 3A through 3L.

A next step in disclosed methods can include a step of forming a photoresist mask 303. A device after such a step can be seen in FIGS. 3C and 3D, for example. The photoresist mask 303 can be configured so that at least one opening 305 remains that can be utilized to form a disc of an NTL. In some embodiments, a photoresist mask 303 can include more than one opening. In some embodiments, such as that depicted herein, the disc, and therefore the opening, can have a circular configuration. The dimensions and configurations of the photoresist mask 303 and the associated opening 305 (or openings) could be similar to dimensions and configurations of discs of NTLs. A layer of the plasmonic material 301 will exist below the opening 305.

Figure 3E:
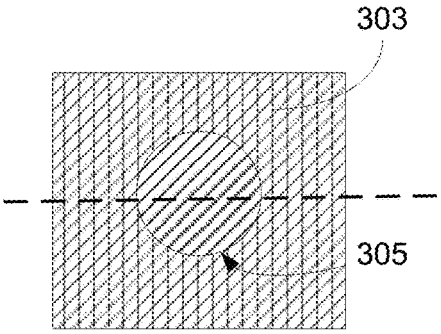
Figure 3F:
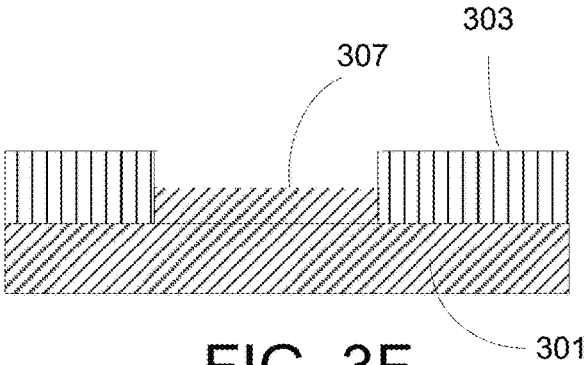

A next step in disclosed methods can include a step of electrodepositing a second material, for example a second plasmonic material. A device after such a step can be seen in FIGS. 3E and 3F. The device includes the sheet of plasmonic material 301, the photoresist mask 303 and a second plasmonic material 307. As seen in FIGS. 3E and 3F, the second plasmonic material 307 is deposited at least in the at least one opening of the photoresist mask (although it could also be deposited at other locations), but does not entirely fill the at least one opening. The photoresist mask can be configured so that the desired thickness of the second plasmonic material does not entirely fill the opening 305. Stated another way, the thickness of the second plasmonic material is less than the depth of the opening (or the thickness of the photoresist mask). In some embodiments, the initial (on the bottom) portion of the plasmonic material will function as plasmonic in the NFT and additional plasmonic material will function mostly as a heat sink. In some embodiments, plasmonic material above 50 nm will generally function as a heat sink. In some embodiments, plasmonic material above 25 nm will generally function as a heat sink.

In some embodiments, the second plasmonic material can be different than the first plasmonic material (plasmonic material 301). In some embodiments, the second plasmonic material can be the same as the first plasmonic material. Exemplary plasmonic materials can include, for example Au, Ag, Cu, and alloys thereof (with the additional elements alloyed in adding desired properties but not detrimentally affecting the plasmonic properties). In some embodiments, the plasmonic material deposited in the at least one opening can form a disc of a NTL. In some embodiments, part of the plasmonic material deposited in the at least one opening can function as the disc of a NTL and part of the plasmonic material deposited in the at least one opening can function as a heat sink of a NTL.

Figure 3G:
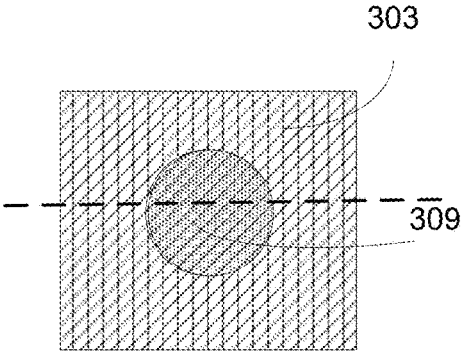
Figure 3H:
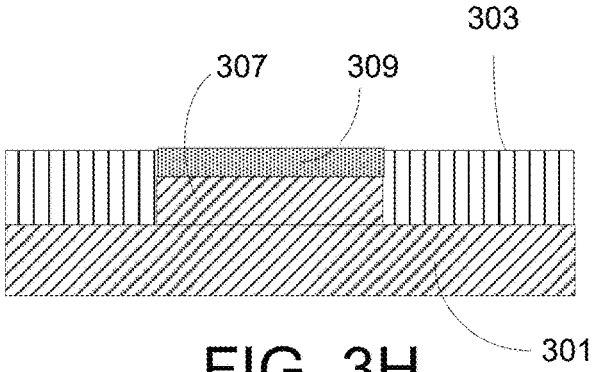
Figure 3I:
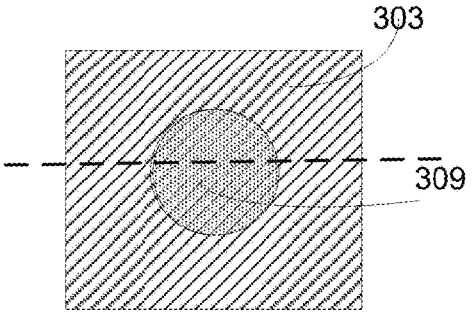
Figure 3J:
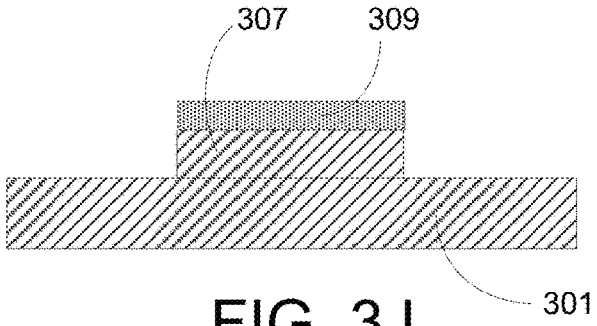
Figure 3K:
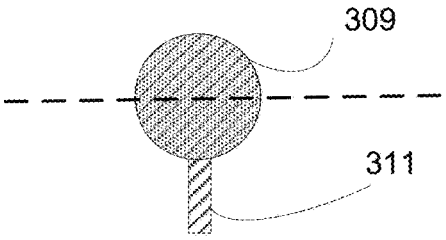
Figure 3L:
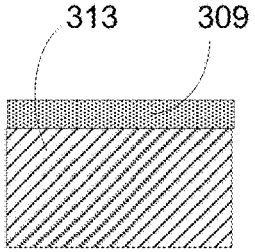

A next step in disclosed methods can include a step of depositing a diffusion barrier material on at least the second plasmonic material 307 in the at least one opening 305. A device after such a step is depicted in FIGS. 3G and 3H. Such a device includes the sheet of plasmonic material 301, the photoresist mask 303, a second plasmonic material 307 in the at least one opening of the photoresist mask and a diffusion barrier material 309. The diffusion barrier material 309 is deposited at least on the surface of the second plasmonic material 307 within the opening 305, but could be deposited on additional surfaces. Exemplary materials that could be utilized as diffusion barrier materials can include, for example Rh, W, Ta, TaN, Ru, Ti, and TiN. In some embodiments, the thickness of the diffusion barrier material can be from 50 to 250 nm thick, for example.

The diffusion barrier material 307 can be deposited using known methods. For example, the diffusion barrier material can be electrodeposited using known methods. In some embodiments, the diffusion barrier material may not be a material that can be readily electrodeposited (or electrodeposition may simply not be desirable), in such embodiments, the diffusion barrier material could be deposited using for example some type of physical deposition, such as vacuum deposition.

A next step includes removal of the photoresist mask. A device after such a step can be seen in FIGS. 3I and 3J. The device includes the sheet of the first plasmonic material 301, the second plasmonic material 307, and the diffusion barrier material 309. The photoresist mask can be removed using processes and techniques known to those utilizing photolithography methods such as ash and strip.

A next step includes patterning of the rod feature of the NTL. This step can include photolithography steps, for example, the area where the rod is to be located can be protected by a mask (this step could be accomplished similarly to, and the device could appear similar to the device depicted in FIGS. 2I and 2J). The device after this step includes the rod 311, the disc 313 (which may include a portion of the first plasmonic material and the second plasmonic material), and the diffusion barrier material 309.

Methods such as those depicted by FIGS. 3A through 3L can be advantageous because more than one layer or structure (for example a diffusion barrier and the plasmonic material of the disc, the plasmonic material of the disc and a heat sink thereon, a diffusion barrier, the plasmonic material of the disc, and a heat sink thereon) can be deposited using only one lithography step (e.g., formation of one photoresist mask forming the opening for the eventual disc and other optional features). Such methods can also be advantageous because they can combine the advantages of electrodepositing the plasmonic material (desired properties, etc.) with the ability to otherwise deposit (not via electrodeposition) additional structures such as the diffusion barrier material. Such combinations may lead to advantageous gains in reliability of devices fabricated using such methods.

EXAMPLES

While the present disclosure is not so limited, an appreciation of various aspects of the disclosure will be gained through a discussion of the examples provided below. Electrodeposited gold can be deposited from either a cyanide containing bath or a non-cyanide bath. For example, a cyanide bath could typically contain 10-20 g/l of $KAu(CN)_2$, 30-70 g/l of Citrate acid, with pH adjusted between 3-4. The plating current density could be 10-20 mA/cm$^2$. A non-cyanide type sulfite-thiosulfate bath could typically contain $NaAuCl_4$ 0.05-0.1M, $Na_2SO_3$ 0.3-0.6M, $Na_2S_2O_3$ 0.4-0.6M and $Na_2HPO_4$ 0.2-0.6M, at pH 6-8 and plated at a current density of 1-3 mA/cm$^2$.

Methods disclosed herein can be advantageous because they utilize materials having advantageous properties. In some embodiments, electrodeposited gold (for example) can be morphologically stable.

Figure 4E:
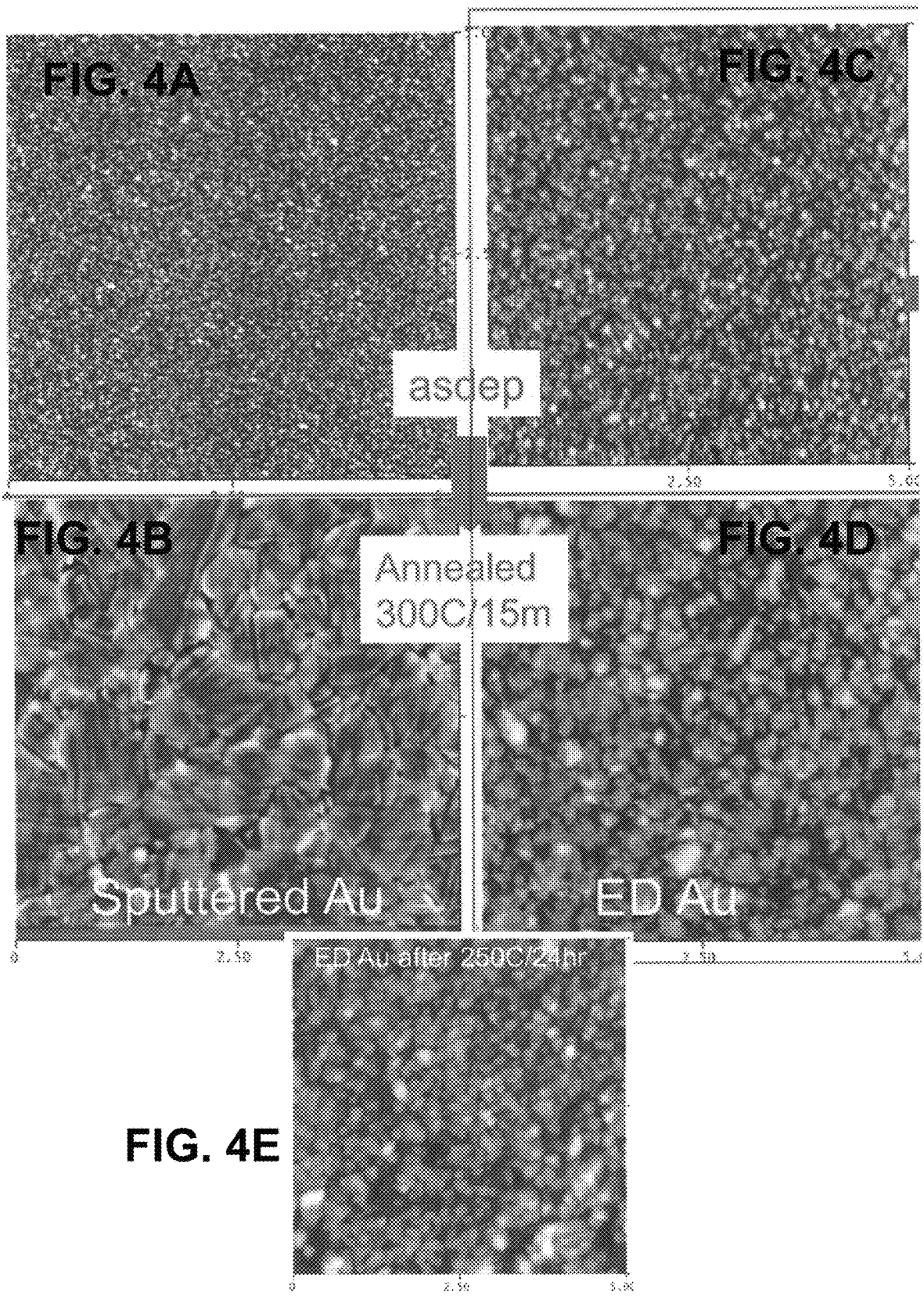

FIGS. 4A through 4E are Atomic Force microscope (AFM) images of sputtered and electrodeposited gold before and after annealing. Specifically, FIG. 4A is a AFM image of as deposited sputtered gold and FIG. 4B is a SEM image of the same sputtered gold after being annealed at about 300° C. for about 15 minutes; FIG. 4C is a AFM image of as deposited electrodeposited gold and FIG. 4D is a AFM image of the same electrodeposited gold after being annealed at about 300° C. for about 15 minutes; and FIG. 4E is a AFM image of electrodeposited gold after being annealed at about 250° C. for about 24 hours. As seen from a comparison of these images, the electrodeposited gold shows better morphological stability after being annealed at 300° C. for about 15 minutes than does the sputtered gold. This is thought to be true because sulfur (S) compounds from the plating solution will get into the gold grain boundaries and help to prevent the grain growth at high temperatures. The sample annealed at 250° C. for about 24 hours also shows advantageous morphological properties.

Methods disclosed herein can also be advantageous because they utilize materials having advantageous microstructure stability.

Figure 5A:
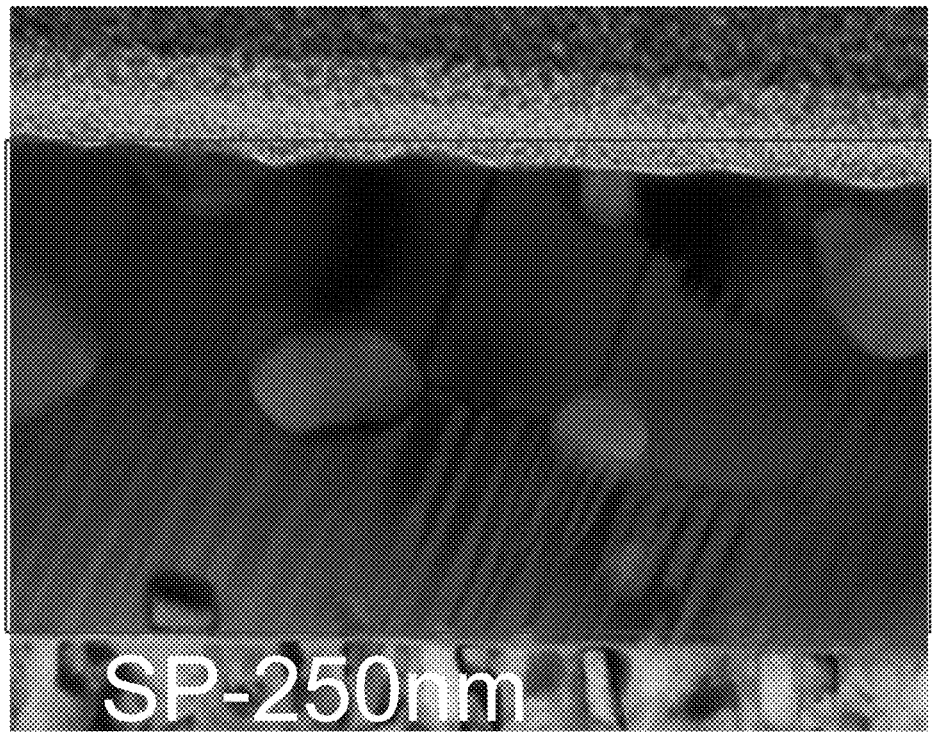
FIGS. 5A through 5D are transmission electron microscopy (TEM) images of a sputtered and electrodeposited gold before and after annealing, with FIG. 5A being a TEM image of a 250 nm thick as deposited sputtered gold.
Figure 5B:
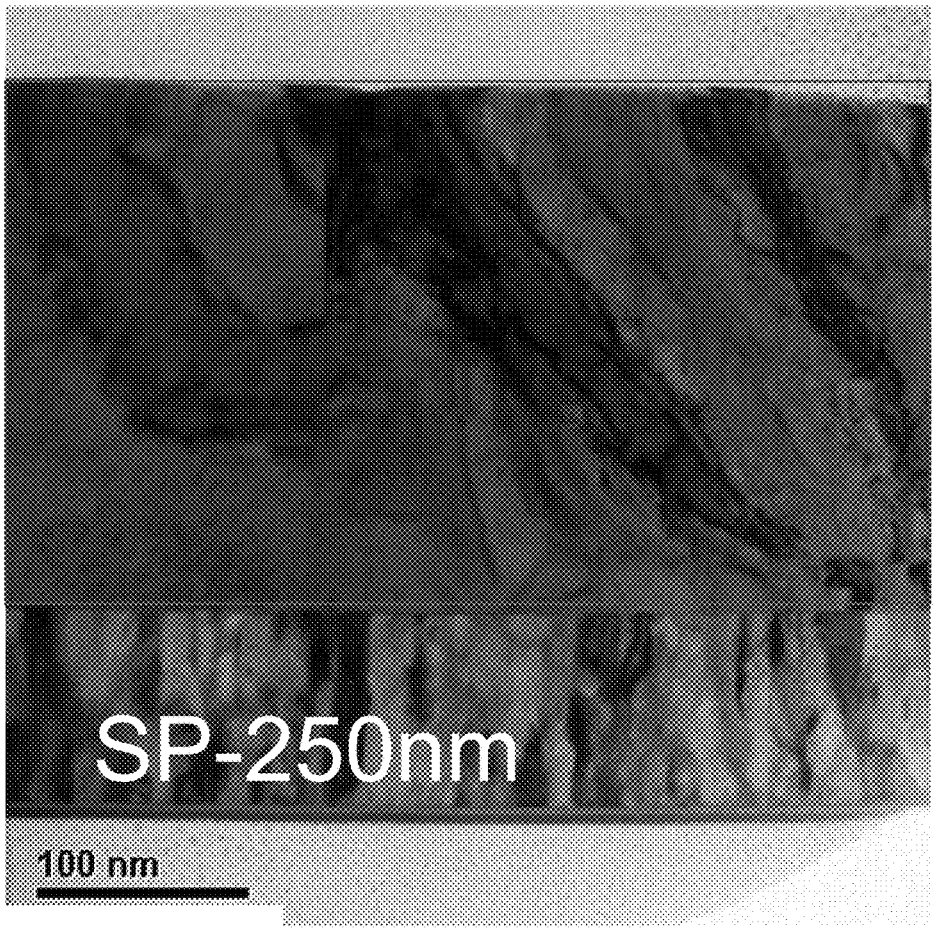
Figure 5C:
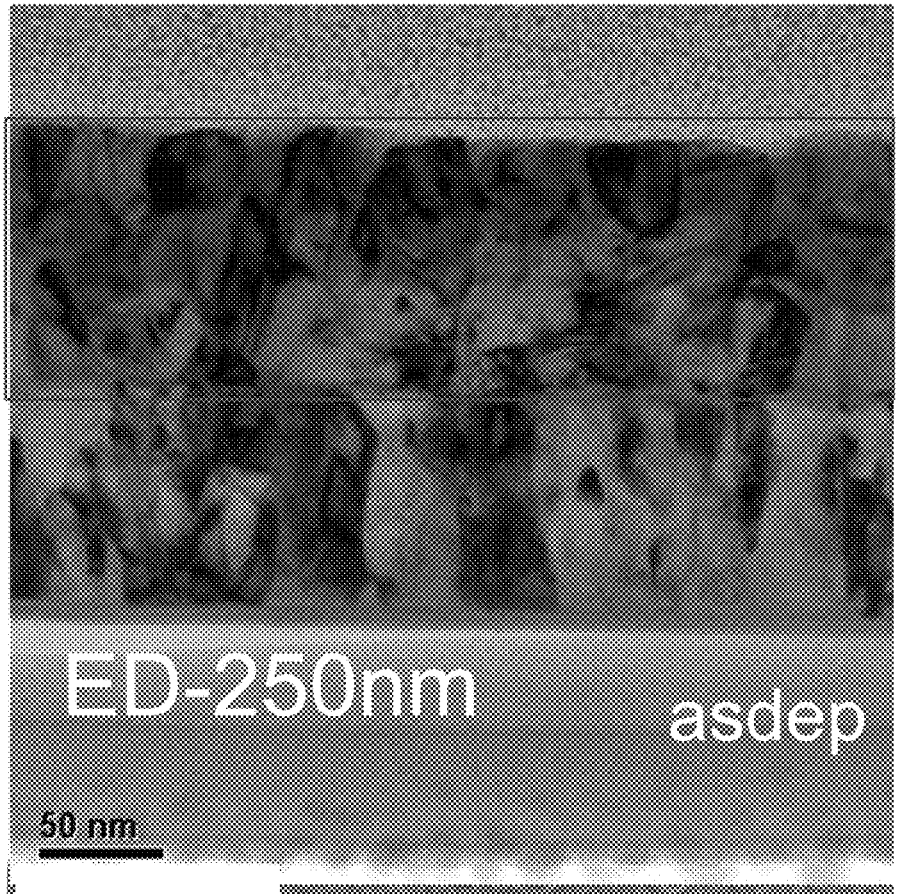
Figure 5D:
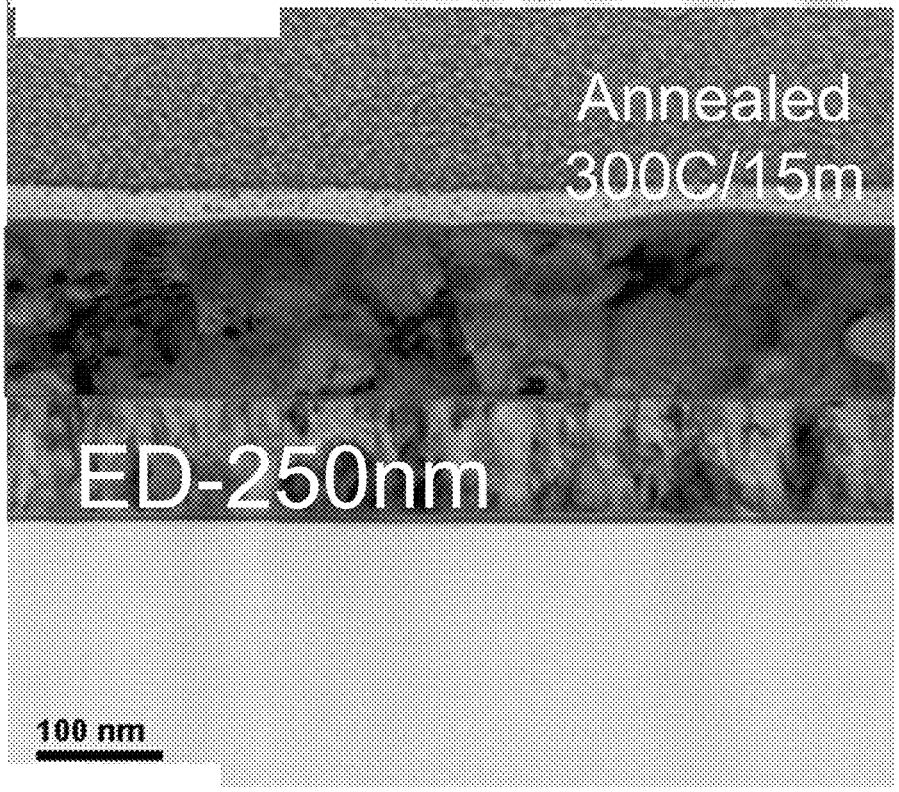

FIGS. 5A through 5D are transmission electron microscope (TEM) images of a sputtered and electrodeposited gold before and after annealing. Specifically, FIG. 5A is a TEM image of a 250 nm thick as deposited sputtered gold and FIG. 5B is a TEM image of the same sputtered gold after being annealed at about 300° C. for about 15 minutes; FIG. 5C is a TEM image of a 250 nm thick as deposited electrodeposited gold and FIG. 5D is a TEM image of the same electrodeposited gold after being annealed at about 300° C. for about 15 minutes. As seen from a comparison, the electrodeposited gold shows better microstructure stability. This is thought to be true because sulfur (S) compounds from the plating solution will get into the gold grain boundaries and help to prevent the grain growth at high temperatures.

Methods disclosed herein can also be advantageous because they utilize materials having advantageously enhanced hardness.

Figure 6:
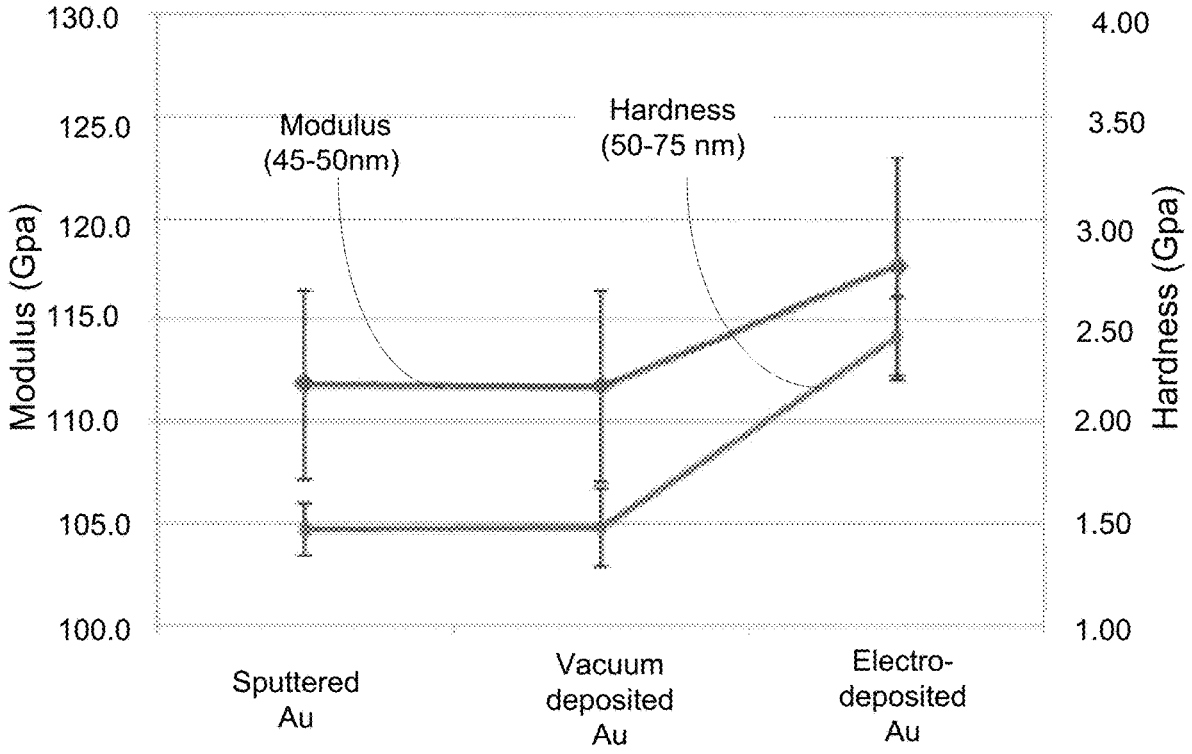
FIG. 6 is a graph showing the modulus (Gpa) at 45 to 50 nm and hardness at 50 to 75 nm (Gpa) of a sputtered gold sample, a vacuum deposited gold sample and an electrodeposited gold sample.

FIG. 6 is a graph showing the modulus (Gpa) at 45 to 50 nm and hardness at 50 to 75 nm (Gpa) of a sputtered gold sample, a vacuum deposited gold sample and an electrodeposited gold sample. As seen there, the electrodeposited sample has a higher modulus and hardness than both the sputtered and vacuum deposited gold samples.

Methods disclosed herein can also be advantageous because they can create materials having advantageous optical properties.

Table 1 below shows the refractive index (n) and the extinction coefficient (k) of sputtered gold (SP in table 1), vacuum deposited gold (VD in table 1), and electrodeposited gold (ED in table 1), as deposited, after being annealed at 200° C. for about 15 minutes and after being annealed at 300° C. for about 15 minutes.

TABLE 1

| | As deposited | | Annealed at 200° C. for 15 minutes | | Annealed at 300° C. for 15 minutes | |
|---|---|---|---|---|---|---|
| | n | k | n | k | n | k |
| SP | 0.13 | 5.3 | 0.13 | 5.4 | 0.14 | 5.4 |
| VD | 0.14 | 5.3 | 0.13 | 5.4 | 0.14 | 5.4 |
| ED | 0.25 | 5.2 | 0.18 | 5.2 | 0.16 | 5.3 |

As seen from Table 1, electrodeposited gold has optical properties that are similar to that of vacuum deposited and sputtered gold.

Thus, embodiments of near field transducers including electrodeposited plasmonic materials are disclosed. The implementations described above and other implementations are within the scope of the following claims. One skilled in the art will appreciate that the present disclosure can be practiced with embodiments other than those disclosed. The disclosed embodiments are presented for purposes of illustration and not limitation.

What is claimed is:

1. A method of forming a lollipop type near field transducer (NFT), the method comprising the steps:

electrodepositing a sheet of a first plasmonic material the first plasmonic material selected from gold (Au), silver (Ag), copper (Cu), and alloys thereof;

forming a photoresist mask, the photoresist mask forming at least one opening;

electrodepositing a second plasmonic material at least in the at least one opening of the photoresist mask, the second plasmonic material selected from gold (Au), silver (Ag), copper (Cu), and alloys thereof;

electrodepositing a third material after the second plasmonic material is deposited in the at least one opening of the photoresist mask, the third material selected from: rhodium (Rh), tungsten (W), tantalum (Ta), tantalum nitride (TaN), ruthenium (Ru), titanium (Ti), and titanium nitride (TiN);

removing the photoresist mask; and forming a rod, wherein the rod is formed from at least a portion of the first plasmonic material.

2. The method of claim 1, wherein the first and the second plasmonic materials are the same.

3. The method according to claim 1 further comprising depositing a seed layer before the sheet of the first plasmonic material is deposited.

4. The method of claim 1, wherein forming the rod comprises photolithography.

5. The method of claim 1 further comprising removing unwanted material after formation of the rod to obtain a NFT comprising the rod and associated disc.

6. A method of forming a lollipop type near field transducer (NFT), the method comprising the steps:

electrodepositing a sheet of a first plasmonic material the first plasmonic material selected from gold (Au), silver (Ag), copper (Cu), and alloys thereof;

forming a photoresist mask, the photoresist mask forming at least one opening;

electrodepositing a second plasmonic material at least in the at least one opening of the photoresist mask, wherein the second plasmonic material does not entirely fill the at least one opening and the second plasmonic material selected from gold (Au), silver (Ag), copper (Cu), and alloys thereof;

depositing a diffusion barrier material on the second plasmonic material in at least the at least one opening the diffusion barrier material selected from: rhodium (Rh), tungsten (W), tantalum (Ta), tantalum nitride (TaN), ruthenium (Ru), titanium (Ti), and titanium nitride (TiN);

removing the photoresist mask; and forming a rod, wherein the rod is formed from at least a portion of the first plasmonic material.

7. The method of claim 6, wherein the diffusion barrier material is electrodeposited.

8. The method of claim 6, wherein the diffusion barrier material is vacuum deposited.

9. The method of claim 6, wherein forming the rod comprises photolithography.

* * * * *